US011460799B2

(12) United States Patent
Lim et al.

(10) Patent No.: US 11,460,799 B2
(45) Date of Patent: Oct. 4, 2022

(54) DECOUPLING BETWEEN CONSUMABLE AND IMAGE FORMING APPARATUS

(71) Applicant: Hewlett-Packard Development Company, L.P., Spring, TX (US)

(72) Inventors: Mokhwa Lim, Pangyo (KR); Sunyoung Park, Pangyo (KR); Hyeonseung Lee, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,757

(22) PCT Filed: Jan. 8, 2020

(86) PCT No.: PCT/US2020/012693
§ 371 (c)(1),
(2) Date: Jun. 3, 2021

(87) PCT Pub. No.: WO2021/034344
PCT Pub. Date: Feb. 25, 2021

(65) Prior Publication Data

US 2022/0179354 A1 Jun. 9, 2022

(30) Foreign Application Priority Data

Aug. 20, 2019 (KR) ..... 10-2019-0101735

(51) Int. Cl.
*G03G 15/00* (2006.01)
*G03G 21/16* (2006.01)

(52) U.S. Cl.
CPC ..... *G03G 21/1633* (2013.01); *G03G 15/502* (2013.01); *G03G 15/5079* (2013.01);
(Continued)

(58) Field of Classification Search
CPC ..... G03G 15/502; G03G 15/5079; G03G 15/5091; G03G 15/553; G03G 21/1633;
(Continued)

(56) References Cited

U.S. PATENT DOCUMENTS 7,548,710 B2 6/2009 Gayne et al.
8,192,001 B2 6/2012 Umeda
(Continued)

FOREIGN PATENT DOCUMENTS

EP 2431812 A2 3/2012
EP 2378374 B1 9/2019
(Continued)

*Primary Examiner* — Sophia S Chen
(74) *Attorney, Agent, or Firm* — Jefferson IP Law, LLP

(57) ABSTRACT

An example image forming apparatus includes a coupling device to perform coupling or decoupling between the image forming apparatus and a consumable, a sensor to sense an opening of a cover of the image forming apparatus, and a processor. When receiving an opening sensing signal of the cover from the sensor, the processor determines whether the consumable coupled to the image forming apparatus corresponds to a consumable access condition, and based on a result of determination, transmits a signal requesting decoupling of the consumable corresponding to the consumable access condition to the coupling device.

16 Claims, 10 Drawing Sheets

(52) U.S. Cl.
CPC ..... *G03G 15/5091* (2013.01); *G03G 15/553* (2013.01); *G03G 21/1647* (2013.01)

(58) Field of Classification Search
CPC ..... G03G 21/1647; G03G 15/0877; G03G 15/0881; G03G 15/55; G03G 21/1839; G03G 21/1875; G03G 2221/1654
See application file for complete search history.

(56) References Cited

U.S. PATENT DOCUMENTS

| | | | | |
|---|---|---|---|---|
| 8,509,651 | B2 | 8/2013 | Tsukijima | |
| 9,996,023 | B2 | 6/2018 | Seto | |
| 2010/0329704 | A1* | 12/2010 | Tachibana | G03G 15/553 399/81 |
| 2011/0058825 | A1* | 3/2011 | Tsukijima | G03G 21/1633 399/258 |
| 2011/0091222 | A1 | 4/2011 | Kim et al. | |
| 2013/0028617 | A1 | 1/2013 | Fukuoka et al. | |
| 2017/0315499 | A1 | 11/2017 | Maeda | |

FOREIGN PATENT DOCUMENTS

| | | |
|---|---|---|
| JP | 20060308794 | 11/2006 |
| JP | 2016-177115 A | 10/2016 |

* cited by examiner

FIG. 10

LaserJet MFP E72525
LaserJet MFP E72525 130.31.15.124

Search by Keyword

User : Administrator
Sign Out

Information General Copy/Print Scan/Digital Send Fax Supplies Troubleshooting Security Web Service Networking General Security
Account Policy
Access Control
Protect Stored Data
Manage Remote Apps
Certificate Management
Email Domain Restriction
Web Service Security
Self Test Consumable Access Control Help Consumable Access Control is a print security service that provides the ability to lock or unlock consumable Set Consumable Access Control

- [x] Enable Consumable Access Control
  A valid Customer ID is required for Track and Trace functionality.
  A Customer ID is provided from the onboarding web page.
- [x] Enable Auto Ejection
  Eject works automatically when door open
  - ◎ Always
  - ◉ Only when following conditions happen
    - □ Admin login
    - □ Service Mode
    - □ Based on remaining Under [ ] %
    - □ Based on Error Code or Event
      - □ Supply Error
      - □ Incompatible Cartridge
      - □ Cartridge Problem
      - □ Development Unit Error
      - □ ···
    - □ Based on time
      - □ Period [ ] ~ [ ]
      - □ Timeout [ ]
  - □ Auto Ejection Confirm Popup Apply Cancel

DECOUPLING BETWEEN CONSUMABLE AND IMAGE FORMING APPARATUS

BACKGROUND

A photoconductor used in an image forming apparatus such as a printer, a copier, a scanner, a multifunction device, or the like is an example of a consumable that may be replaced when its usage amount has expired. A user may check a state or a replacement time of a consumable through a user interface device of the image forming apparatus and may replace a consumable that has reached a replacement time directly or with the help of a service technician.

BRIEF DESCRIPTION OF THE DRAWINGS

FIG. 10 is a diagram illustrating a user interface screen for setting a consumable access condition for a consumable access control according to an example.

DETAILED DESCRIPTION OF EXAMPLES

Figure 1:
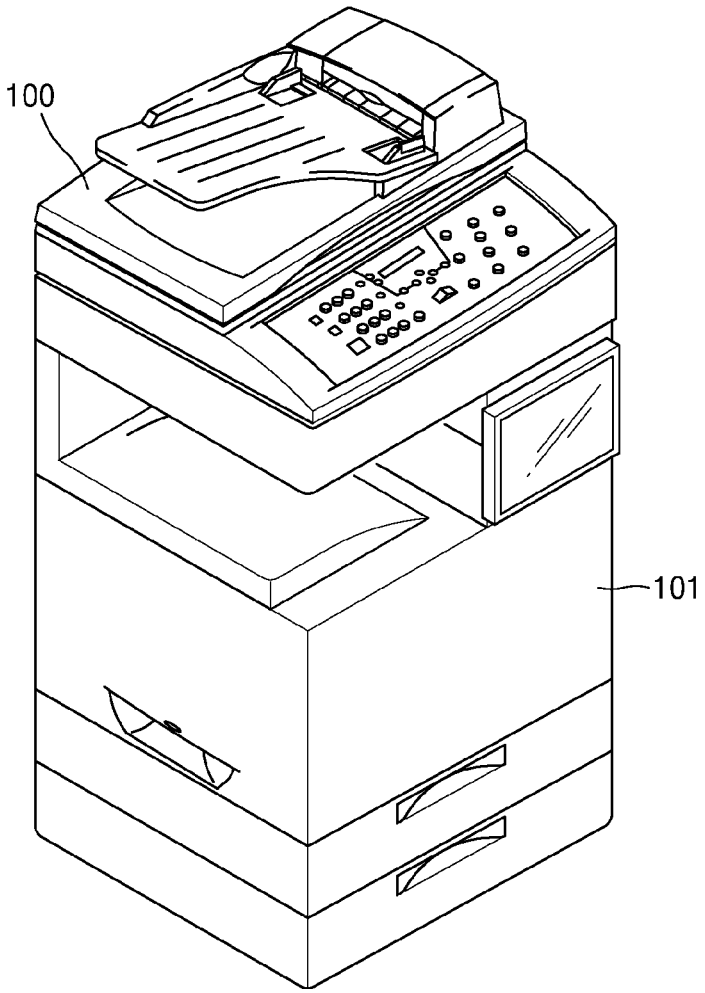
FIG. 1 is a diagram illustrating an image forming apparatus including a cover according to an example.

Hereinafter, various examples will be described with reference to the drawings. Like reference numerals in the specification and the drawings denote like elements, and thus their descriptions will be omitted.

FIG. 1 is a diagram illustrating an image forming apparatus including a cover according to an example.

Referring to FIG. 1, an image forming apparatus 100 generally refers to an apparatus capable of performing an image forming job, such as a printer, a copier, a scanner, a multifunction printer, a fax machine, etc. The term image forming job may refer to any of various jobs related to an image, for example, printing, copying, scanning, faxing, or the like, and may include a series of processes required for performing the image forming job. The image forming apparatus 100 may receive a request for the image forming job from a user through a user interface device 110 and perform the requested image forming job.

The image forming apparatus 100 may include at least one cover 101 in a main body. The user may open the cover

101 of the image forming apparatus 100 to gain access to the inside of the main body, such as to replace or inspect parts or consumables. As shown in FIG. 1, the cover 101 may be positioned at a front surface of the image forming apparatus 100, but a position of the cover 101 is not limited thereto.

Figure 2:
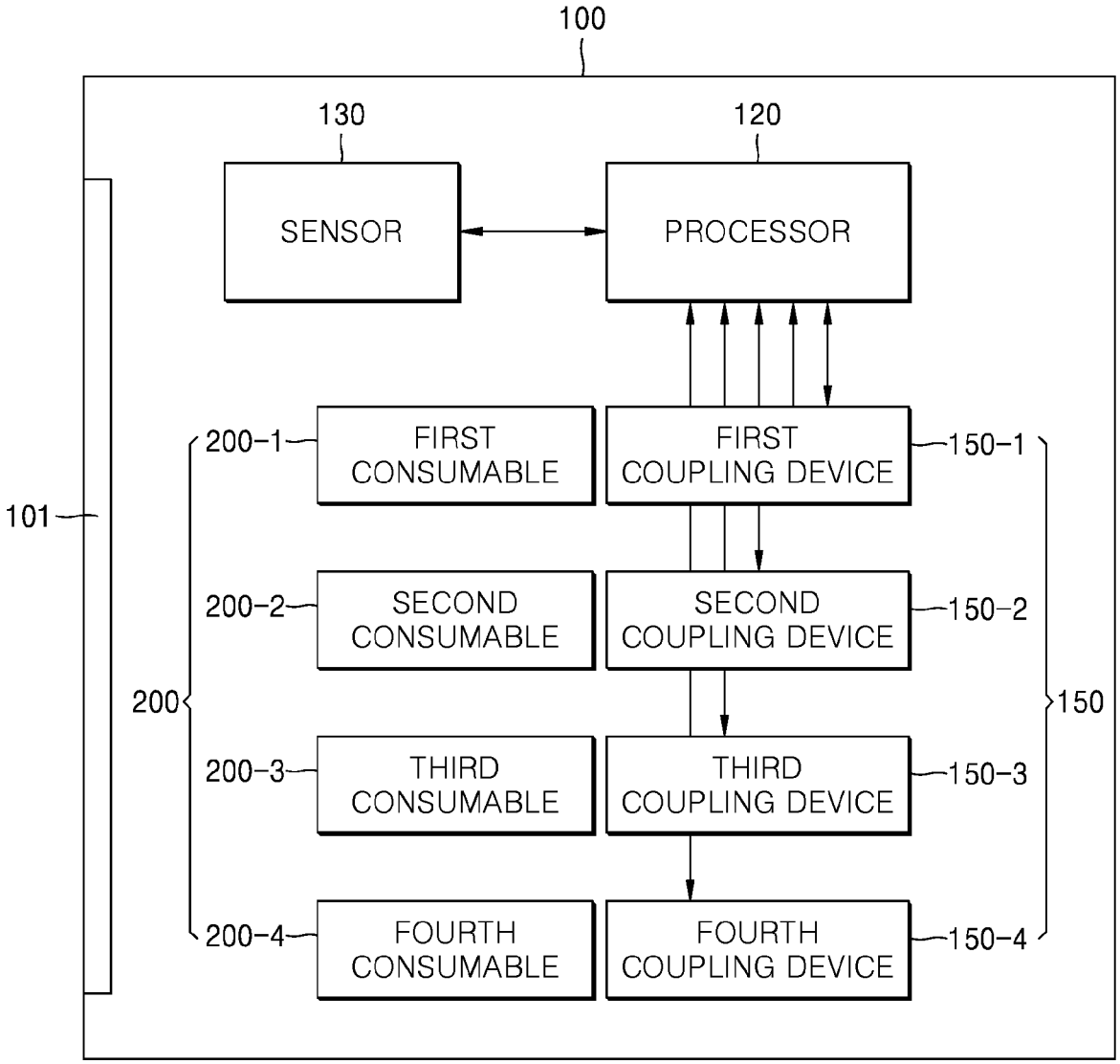
FIG. 2 is a block diagram illustrating an image forming apparatus to which a consumable is coupled according to an example.

FIG. 2 is a block diagram illustrating an image forming apparatus to which a consumable is coupled according to an example.

Referring to FIG. 2, the image forming apparatus 100 may operate using a variety of kinds or types of consumables 200. Each of the consumables 200 may be replaced when an end of life or end of use of the consumable has been reached, when a user desires to inspect the consumable, or as needed. The image forming apparatus 100 may provide a consumable access control function such that one or more of the consumables 200 may be replaced or inspected only when one or more of the consumables 200 corresponds to a replacement condition or an inspection condition. When none of the consumables 200 corresponds to the replacement condition or the inspection condition according to the consumable access control, the image forming apparatus 100 may maintain the coupling state in which the consumables 200 are inserted, locked, and coupled to the image forming apparatus 100. Further, even when one or more of the consumables 200 corresponds to the replacement condition or the inspection condition, it may be necessary for the user to request the image forming apparatus 100 to decouple the corresponding consumables 200, such as by a manual input by the user. In an example of decoupling one or more of the consumables 200 from the image forming apparatus 100, the one or more of consumables 200 that are coupled to the image forming apparatus 100 may be unlocked, pushed in a direction opposite to that of an insertion direction, and decoupled from the image forming apparatus 100.

Hereinafter, an example method in which the image forming apparatus 100 safely manages the consumables 200 according to the consumable access control when one or more of the consumables 200 corresponds to the replacement condition or the inspection condition, minimizes an intervention of the user for the convenience of the user, and automatically decouples the one or more of consumables 200 coupled to the image forming apparatus 100 will be described.

As illustrated in FIG. 2, the image forming apparatus 100 may include the cover 101, a processor 120, a sensor 130, and a coupling device 150.

The image forming apparatus 100 may be coupled to the consumables 200 through the coupling device 150. The coupling device 150 may perform coupling or decoupling between the image forming apparatus 100 and the consumables 200. The coupling device 150 may include a connector to connect the image forming apparatus 100 and the consumables 200 and a pusher to push the consumables 200. The consumables 200 may be inserted into the image forming apparatus 100 and engaged with the coupling device 150. When the consumables 200 are engaged with the coupling device 150, the coupling device 150 may rotate in a first direction according to driving of a driver such as a supply motor so that the consumables 200 are locked and coupled to the image forming apparatus 100. On the contrary, the consumables 200 may be unlocked when the coupling device 150 rotates in a reverse direction of the first direction, and pushed in a direction opposite to the direction in which the consumables 200 are inserted into the image forming apparatus 100, so as to decouple the consumables 200 from the image forming apparatus 100.

The sensor 130 may sense an opening of the cover 101 of the image forming apparatus 100. The sensor 130 may be positioned near the cover 101 to sense a degree of opening of the cover 101 in real time. The sensor 130 may transmit an opening sensing signal of the cover 101 to the processor 120.

When the processor 120 receives the opening sensing signal of the cover 101 from the sensor 130, the processor 120 may determine whether one or more of the consumables 200 coupled to the image forming apparatus 100 corresponds to a consumable access condition. When the processor 120 receives the opening sensing signal of the cover 101 from the sensor 130, the processor 120 may determine whether each of a state of the image forming apparatus 100 and a state of one or more of the consumables 200 coupled to the image forming apparatus 100 corresponds to a predetermined condition.

For example, the processor 120 may determine whether the image forming apparatus 100 is in a predetermined operation mode or a previously designated user login mode. The processor 120 may also determine whether one or more of the consumables 200 coupled to the image forming apparatus 100 corresponds to the replacement condition or the inspection condition. As an example, when one or more of the consumables 200 coupled to the image forming apparatus 100 includes a toner cartridge, the processor 120 may determine whether an event related to the toner cartridge such as an error code related to the toner cartridge or an event that occurred due to the toner cartridge has occurred in the image forming apparatus 100. The processor 120 may also determine whether one or more of the consumables 200 coupled to the image forming apparatus 100 corresponds to the replacement condition or the inspection condition. The replacement condition or the inspection condition of each of the consumables 200 may be previously set based on an amount of use or a period of use of each of the consumables 200, or may be set to an arbitrary value by the user.

The processor 120 may transmit a signal requesting decoupling of the one or more consumables 200 corresponding to the consumable access condition to the coupling device 150 based on a result of the determination.

The coupling device 150 may unlock the one or more consumables 200 corresponding to the consumable access condition from the image forming apparatus 100 according to the signal requesting decoupling transmitted from the processor 120. The coupling device 150 may also push the one or more consumables 200 corresponding to the consumable access condition in a direction opposite to a direction in which the consumables 200 are inserted into the image forming apparatus 100.

When there are a plurality of coupling devices 150 respectively corresponding to a plurality of consumables, only a coupling device corresponding to one or more of the consumables 200 corresponding to the consumable access condition may perform decoupling between the one or more consumables 200 corresponding to the consumable access condition and the image forming apparatus 100.

Referring to the example illustrated in FIG. 2, the consumables 200 coupled to the image forming apparatus 100 may include four consumables of a first consumable 200-1, a second consumable 200-2, a third consumable 200-3, and a fourth consumable 200-4. The coupling device 150 may include four coupling devices of a first coupling device 150-1, a second coupling device 150-2, a third coupling device 150-3, and a fourth coupling device 150-4 respectively corresponding to the first to fourth consumables 200-1, 200-2, 200-3, and 200-4. The number of consumables 200 and the number of coupling devices 150 is not limited thereto. The processor 120 may determine whether the consumable access condition corresponds to each of the first consumable 200-1, the second consumable 200-2, the third consumable 200-3, or the fourth consumable 200-4. When it is determined that only the first consumable 200-1 corresponds to the consumable access condition, only the first coupling device 150-1 corresponding to the first consumable 200-1 among the first to fourth coupling devices 150-1 to 150-4 may perform decoupling between the first consumable 200-1 corresponding to the consumable access condition and the image forming apparatus 100.

Figure 3:
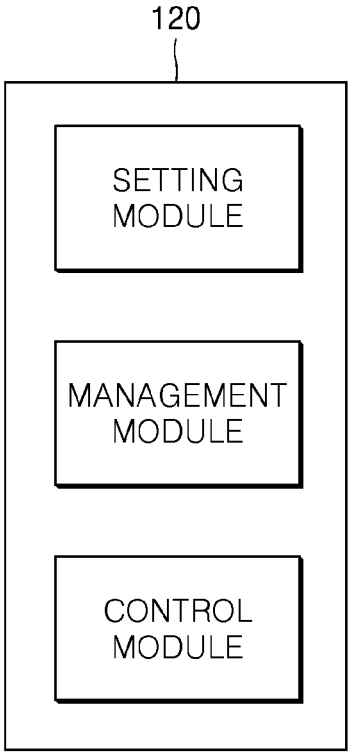
FIG. 3 is a block diagram illustrating a module of a processor according to an example.

FIG. 3 is a block diagram illustrating a module of a processor according to an example.

Referring to FIG. 3, the processor 120 may include a setting module, a management module, and a control module.

The setting module may set a consumable access condition for a consumable access control, set activation of the consumable access control, set activation of decoupling of one or more of the consumables 200 corresponding to the consumable access condition, set activation of a pop-up window display for receiving a user input of whether to decouple the one or more consumables 200 corresponding to the consumable access condition, and manage a plurality of pieces of set information.

The management module may detect information about a state of the image forming apparatus 100, detect information about a state of the consumables 200, analyze whether one or more of the consumables 200 corresponds to the consumable access condition, and generate a signal requesting decoupling of one or more of the consumables 200.

The control module may collect the information about the state of the image forming apparatus 100, collect the information about the state of the consumables 200, transmit the collected information to the management module, and transmit a signal controlling the coupling device 150 to the coupling device 150 based on the signal received from the management module. The information about the state of the consumables 200 may be information stored in a memory (not shown) and received from the consumables 200. In an example, the memory may be a memory in the consumables 200.

Figure 4:
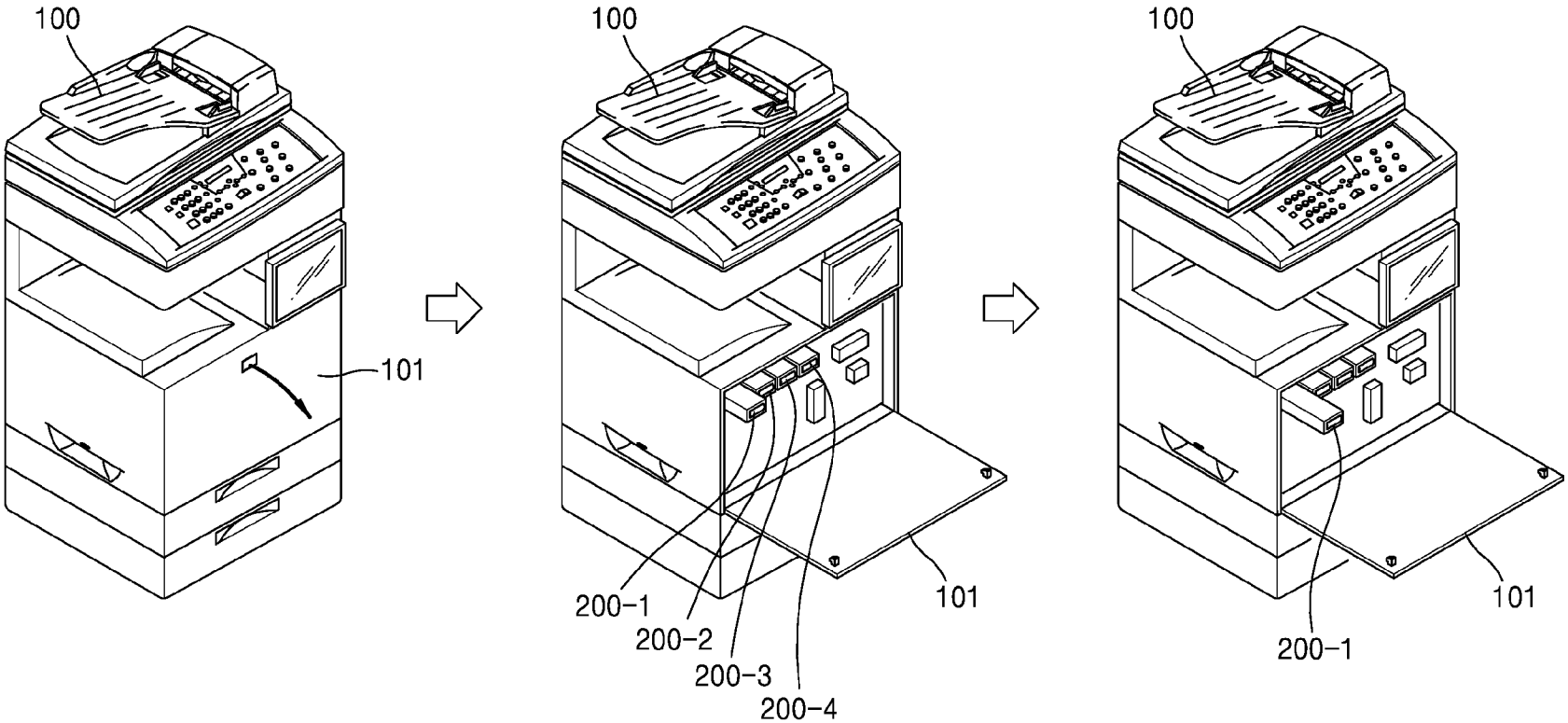
FIG. 4 is a diagram illustrating a process of decoupling between a consumable and an image forming apparatus based on an opening of a cover of the image forming apparatus according to an example.

FIG. 4 is a diagram illustrating a process of decoupling between a consumable and an image forming apparatus based on an opening of a cover of the image forming apparatus according to an example.

Referring to FIG. 4, an example process in which the image forming apparatus 100 determines whether one or more of the consumables 200 coupled to the image forming apparatus 100 corresponds to a consumable access condition because the cover 101 of the image forming apparatus 100 opens and performs decoupling between the one or more of the consumables 200 corresponding to the consumable access condition and the image forming apparatus 100 is illustrated.

In FIG. 4, the consumables 200 that may be replaced or inspected by opening the cover 101 may include the four consumables of the first consumable 200-1, the second consumable 200-2, the third consumable 200-3, and the fourth consumable 200-4. In the example of FIG. 4, only the first consumable 200-1 corresponds to the consumable access condition such that only the first consumable 200-1 may be unlocked from the image forming apparatus 100 and pushed in a direction opposite to a direction in which the first consumable 200-1 is inserted into the image forming apparatus 100.

Figure 5:
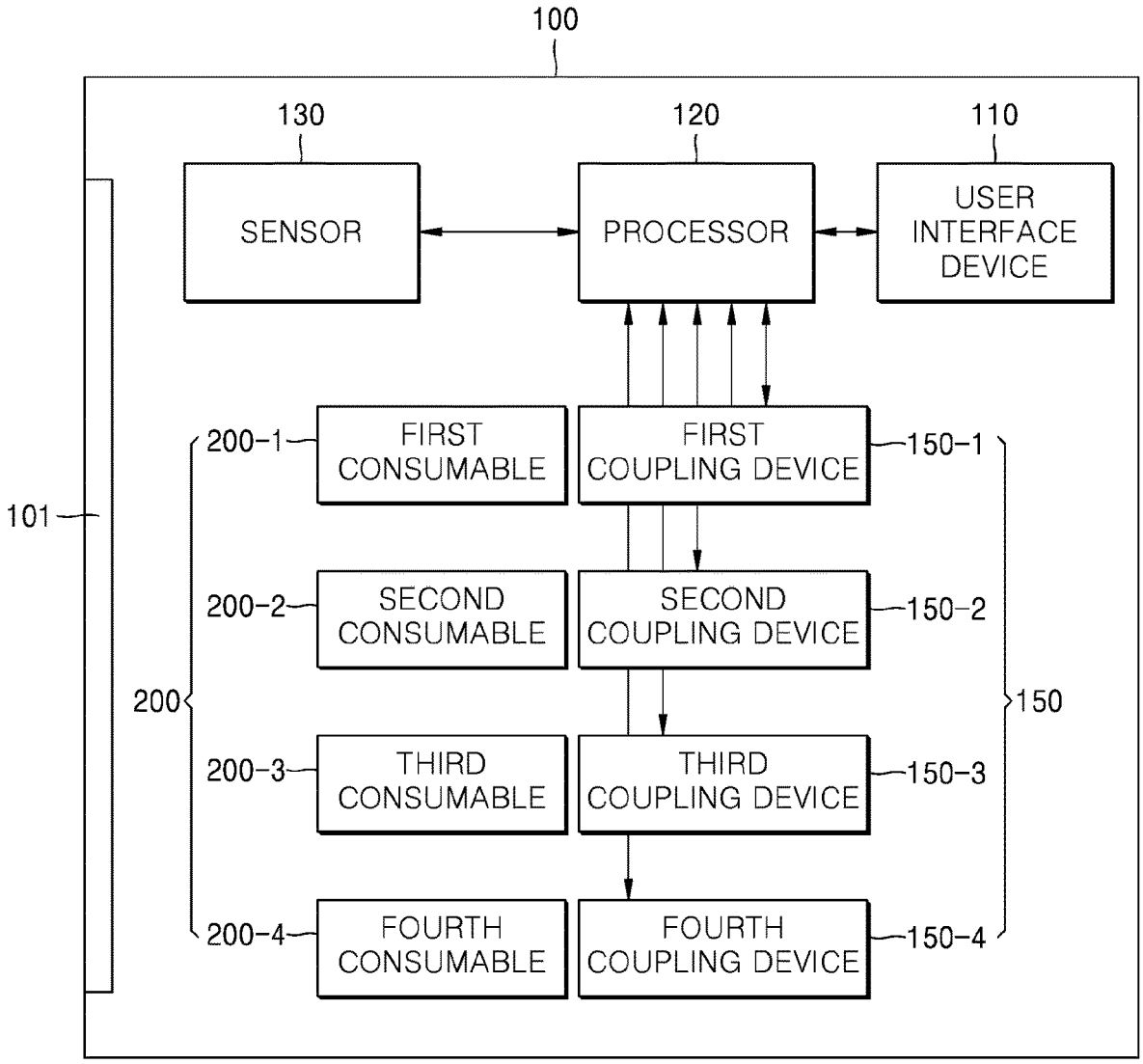
FIG. 5 is a block diagram illustrating a configuration of an image forming apparatus to which consumables are coupled according to an example.

FIG. 5 is a block diagram illustrating a configuration of an image forming apparatus to which consumables are coupled according to an example.

Referring to FIG. 5, the image forming apparatus 100 may include the cover 101, the user interface device 110, the processor 120, the sensor 130, and the coupling device 150. The same descriptions as those given above with reference to FIG. 2 will be omitted below.

When the processor 120 receives an opening sensing signal of the cover 101 from the sensor 130, the processor 120 may determine whether one or more of the consumables 200 coupled to the image forming apparatus 100 corresponds to a consumable access condition. When the processor 120 determines that at least one consumable 200 coupled to the image forming apparatus 100 corresponds to the consumable access condition, the processor 120 may control a process of receiving an approval of a user before transmitting a signal requesting decoupling of the at least one consumable 200 corresponding to the consumable access condition.

The processor 120 may display, through the user interface device 110, a pop-up window to receive a user input of whether to decouple the at least one consumable 200 corresponding to the consumable access condition. The user interface device 110 may receive an input of the user with respect to the displayed pop-up window. The processor 120 may transmit a signal requesting the release of the at least one consumable 200 corresponding to the consumable access condition to the coupling device 150 based on the received user input.

The coupling device 150 may unlock the at least one consumable 200 corresponding to the consumable access condition from the image forming apparatus 100 according to the signal requesting decoupling transmitted from the processor 120. The coupling device 150 may also push the at least one consumable 200 corresponding to the consumable access condition in a direction opposite to a direction in which the at least one consumable 200 is inserted into the image forming apparatus 100.

Even if it is determined that one or more of the consumables 200 coupled to the image forming apparatus 100 does not correspond to the consumable access condition, the processor 120 may display the pop-up window to receive a user input of whether to decouple the one or more consumables 200 through the user interface device 110 such that the one or more consumables 200, which may be arbitrarily selected by the user, may be decoupled from the image forming apparatus 100. The processor 120 may receive a user input with respect to the displayed pop-up window and transmit the signal requesting decoupling of the one or more consumables 200 to the coupling device 150 based on the received user input.

Figure 6:
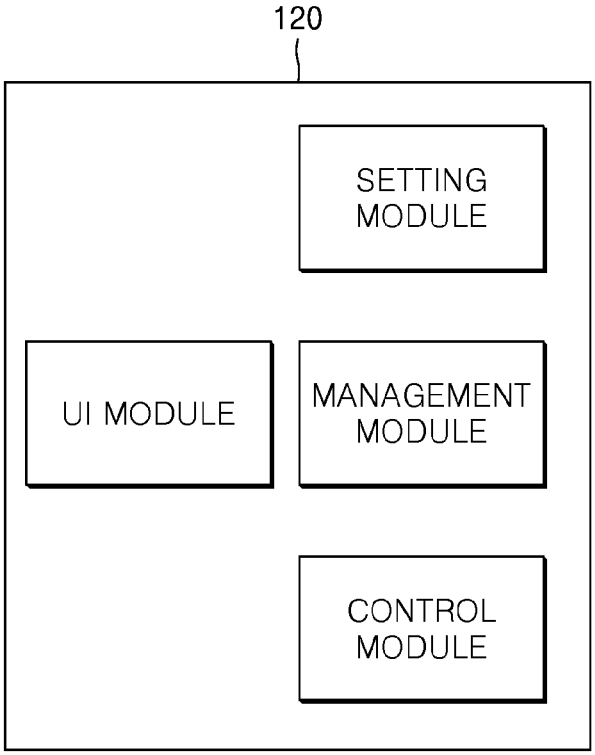
FIG. 6 is a block diagram illustrating a module of a processor according to an example.

FIG. 6 is a block diagram illustrating a module of a processor according to an example.

Referring to FIG. 6, the processor 120 may include a setting module, a management module, a control module, and a user interface (UI) module. The same descriptions as those described in FIG. 3 will be omitted below.

The setting module of FIG. 6 may perform all operations of a setting module of FIG. 3. The setting module of FIG. 6 may further set the activation of a pop-up window display to receive a user input of whether to decouple one or more consumable 200 corresponding to the consumable access condition and manage a plurality of pieces of set information.

The management module of FIG. 6 may perform all operations of a management module of FIG. 3. The management module of FIG. 6 may, when the activation of the pop-up window display is set, request the pop-up window display from the UI module before generating the signal requesting decoupling of the consumables 200.

The UI module of FIG. 6 may generate the pop-up window to receive a user input of whether to decouple the consumables 200, receive the user input with respect to the pop-up window, and transmit the received user input to the management module of FIG. 6.

Figure 7:
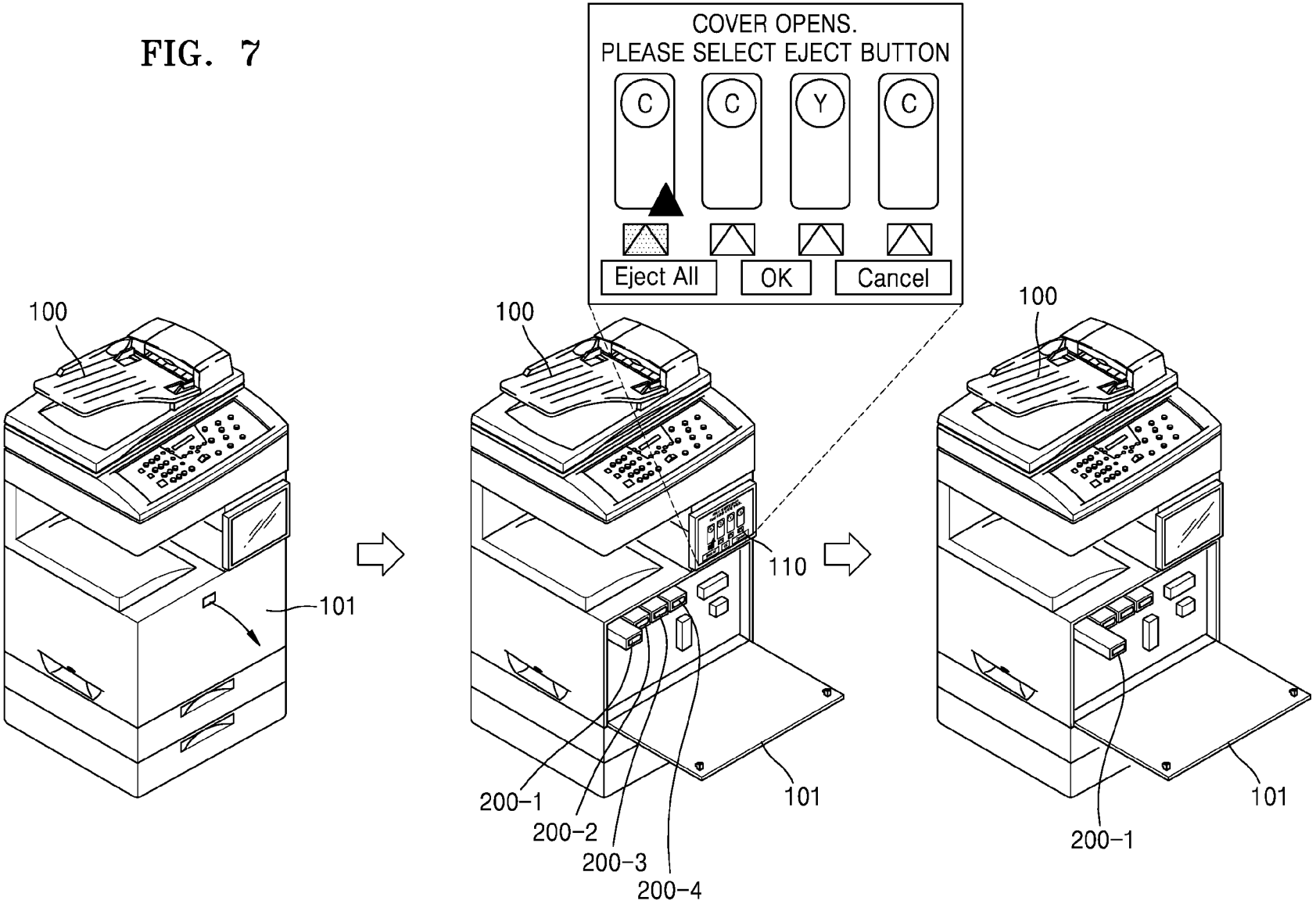
FIG. 7 is a diagram illustrating a process of decoupling between a consumable and an image forming apparatus based on an opening of a cover of the image forming apparatus according to an example.

FIG. 7 is a diagram illustrating a process of decoupling between a consumable and an image forming apparatus based on an opening of a cover of the image forming apparatus according to an example.

Referring to FIG. 7, a process in which the image forming apparatus 100 determines whether one or more of the consumables 200 coupled to the image forming apparatus 100 corresponds to a consumable access condition because the cover 101 of the image forming apparatus 100 opens, receives an approval of a user by displaying a pop-up window to receive the user input of whether to decouple the one or more consumables 200 corresponding to the consumable access condition, and performs decoupling between the one or more consumables 200 corresponding to the consumable access condition and the image forming apparatus 100 is illustrated.

Referring to FIG. 7, the one or more consumables 200 that may be replaced or inspected by opening the cover 101 may include the four consumables of the first consumable 200-1 which is a cyan color toner cartridge, the second consumable 200-2 which is a magenta color toner cartridge, the third consumable 200-3 which is a yellow color toner cartridge, and the fourth consumable 200-4 which is a black color toner cartridge. In the example of FIG. 7, only the first consumable 200-1, which is the cyan color toner cartridge having no remaining toner, corresponds to the consumable access condition. Thus, a pop-up window (i.e., a UI screen) of the user interface device 110 separately displays that the first consumable 200-1 may be decoupled from the image forming apparatus 100.

The user may approve of the decoupling of the first consumable 200-1 by pressing of a virtual button requesting decoupling of the first consumable 200-1 which is a predetermined display on the UI screen of the user interface device 110 shown in FIG. 7. The user may also approve of the decoupling of at least one of the second consumable 200-2 to the fourth consumable 200-4 by further pressing a corresponding virtual button additionally requesting decoupling of the at least one of the second consumable 200-2 to the fourth consumable 200-4. Alternatively, the user may press a cancel button to cancel decoupling of one or all of the consumables 200.

In the example of FIG. 7, according to the approval of the user, only the first consumable 200-1 may be unlocked from the image forming apparatus 100 and pushed in a direction opposite to a direction in which the first consumable 200-1 is inserted into the image forming apparatus 100.

Figure 8:
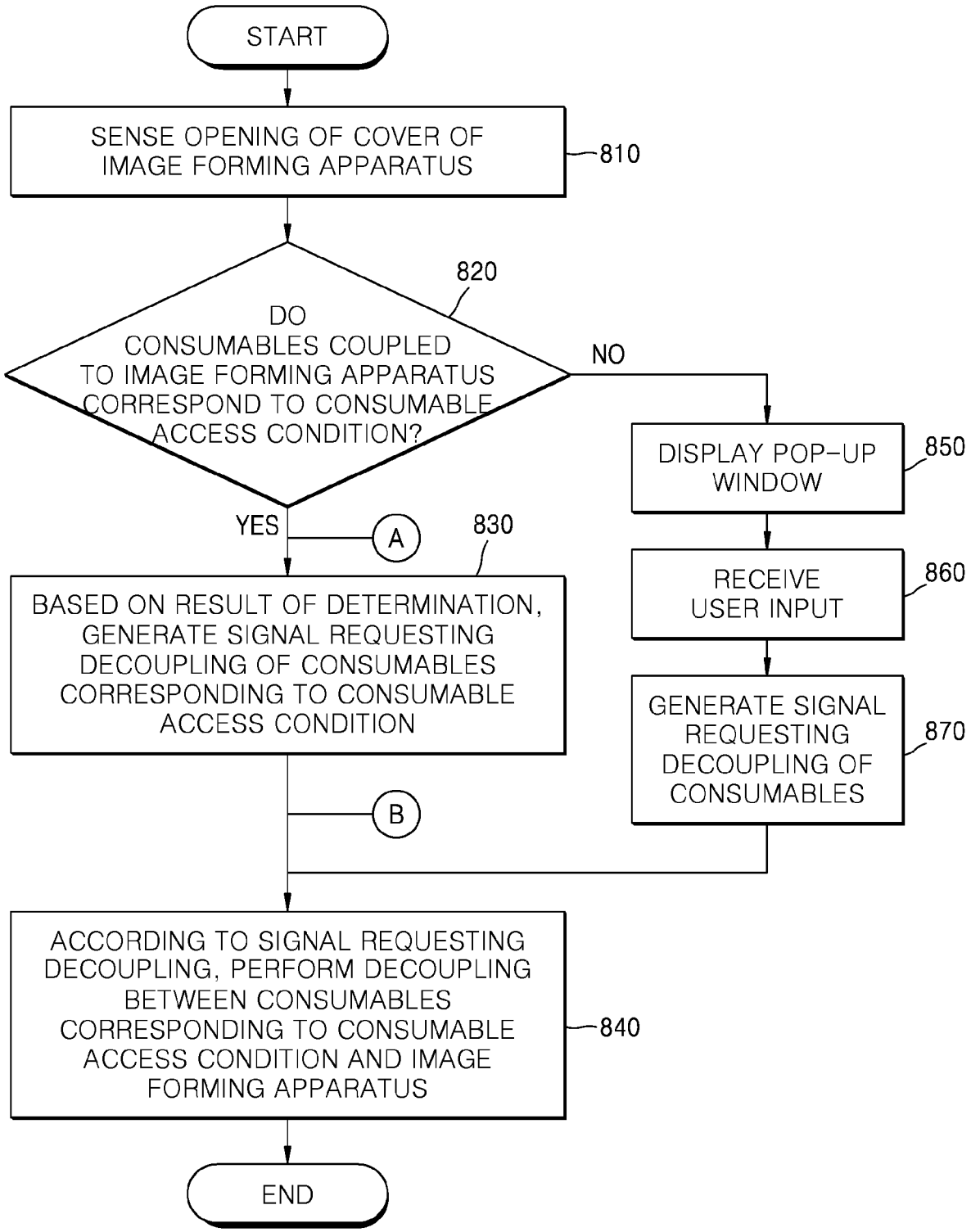
FIG. 8 is a flowchart illustrating a method of removing a consumable from an image forming apparatus according to an example.

FIG. 8 is a flowchart illustrating a method of removing a consumable from an image forming apparatus according to an example.

Referring to FIG. 8, the image forming apparatus 100 may sense an opening of the cover 101 of the image forming apparatus 100 in operation 810.

In operation 820, when the opening of the cover 101 is sensed, the image forming apparatus 100 may determine whether one or more of the consumables 200 coupled to the image forming apparatus 100 corresponds to a consumable access condition. As an example, when the opening of the cover 101 is sensed, the image forming apparatus 100 may determine whether each of a state of the image forming apparatus 100 and a state of one or more of the consumables 200 corresponds to a predetermined condition. For example, the image forming apparatus 100 may determine whether the image forming apparatus 100 is in a predetermined operation mode or a previously designated user login mode. The image forming apparatus 100 may also determine whether the one or more consumables 200 coupled to the image forming apparatus 100 corresponds to the replacement condition or the inspection condition. When the one or more consumables 200 coupled to the image forming apparatus 100 is a toner cartridge, the image forming apparatus 100 may determine whether an event related to the toner cartridge such as an error code related to the toner cartridge or an event that occurred due to the toner cartridge has occurred in the image forming apparatus 100. The image forming apparatus 100 may also determine whether the consumables 200 coupled to the image forming apparatus 100 correspond to the replacement condition or the inspection condition. According to a result of the determination, operation 830 or operation 850 may be performed.

In operation 830, the image forming apparatus 100 may generate a signal requesting decoupling of the one or more consumables 200 corresponding to the consumable access condition based on a result of the determination of operation 820. When at least one consumable 200 coupled to the image forming apparatus 100 corresponds to the consumable access condition, the image forming apparatus 100 may generate the signal requesting decoupling of the at least one consumable 200 corresponding to the consumable access condition.

In operation 840, the image forming apparatus 100 may perform decoupling between the at least one consumable 200 corresponding to the consumable access condition and the image forming apparatus 100 according to the generated signal requesting decoupling. The image forming apparatus 100 may unlock the at least one consumable 200 corresponding to the consumable access condition from the image forming apparatus 100 according to the generated signal requesting decoupling, and may push the at least one consumable 200 corresponding to the consumable access condition in a direction opposite to a direction in which the at least one consumable 200 is inserted into the image forming apparatus 100. When a plurality of coupling devices corresponding to the plurality of consumables are provided in the image forming apparatus 100, only the coupling device 150 corresponding to the at least one consumable 200 corresponding to the consumable access condition may perform decoupling between the at least one consumable 200 corresponding to the consumable access condition and the image forming apparatus 100.

Referring again to operation 820, when the consumables 200 coupled to the image forming apparatus 100 do not correspond to the consumable access condition, a signal requesting decoupling of one or more of the consumables 200 arbitrarily selected by the user may be generated such that the one or more consumable 200 may be decoupled from the image forming apparatus 100 according to operations 850 to 870 as follows.

In operation 850, the image forming apparatus 100 may display a pop-up window for receiving a user input of whether to decouple one or more of the consumables 200 when the consumables 200 coupled to the image forming apparatus 100 do not correspond to the consumable access condition. The image forming apparatus 100 may display the pop-up window for receiving the user input of whether to decouple the consumables 200 even if none of the consumables 200 coupled to the image forming apparatus 100 corresponds to the consumable access condition.

In operation 860, the image forming apparatus 100 may receive a user input with respect to the displayed pop-up window. The user may input a selection to decouple one or more of the consumables 200 in the displayed pop-up window.

In operation 870, the image forming apparatus 100 may generate the signal requesting decoupling of the one or more consumables 200 based on the received user input. Following operation 870, the image forming apparatus 100 may perform decoupling between the one or more consumables 200 and the image forming apparatus 100 according to the signal requesting decoupling generated in operation 840.

Figure 9:
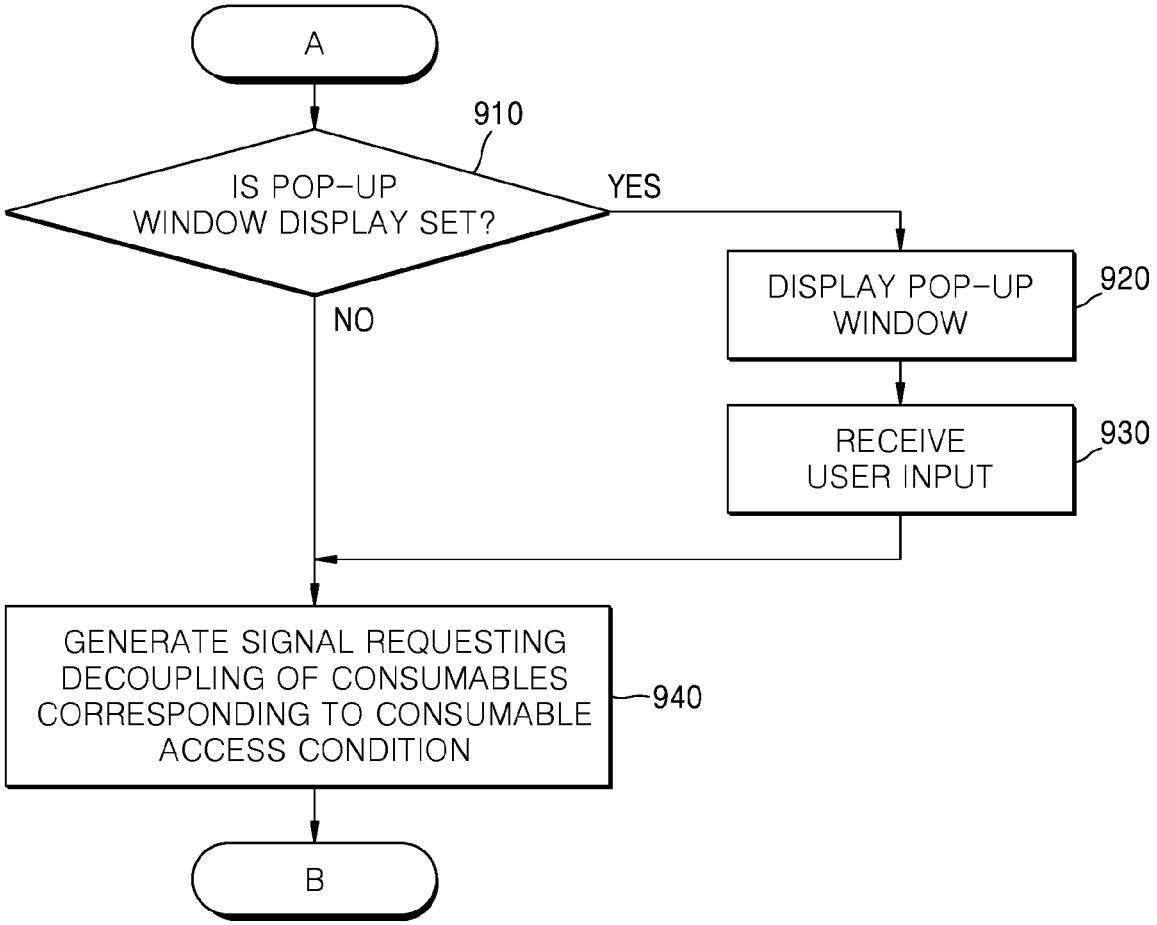
FIG. 9 is a flowchart illustrating a process of requesting decoupling of a consumable corresponding to a consumable access condition according to an example.

FIG. 9 is a flowchart illustrating a process of requesting decoupling of a consumable corresponding to a consumable access condition according to an example.

Referring to FIG. 9, when the image forming apparatus 100 provides an option activating a pop-up window display and the option is set, an operation of the image forming apparatus 100 corresponding to operation 830 of FIG. 8 may be performed according to operations 910 to 940 illustrated in FIG. 9.

In operation 910, the image forming apparatus 100 may determine whether to set the pop-up window display for receiving a user input of whether to decouple one or more of the consumables 200 corresponding to the consumable access condition.

In operation 920, when the pop-up window display for receiving the user input of whether to decouple the one or more consumables 200 corresponding to the consumable access condition is set, the image forming apparatus 100 may display a pop-up window for receiving the user input of whether to decouple the one or more consumables 200 corresponding to the consumable access condition.

In operation 930, the image forming apparatus 100 may receive a user input with respect to the displayed pop-up window. For example, the user may approve decoupling of the one or more consumables 200 corresponding to the consumable access condition on the displayed pop-up window or may further designate one or more consumables 200 to be additionally decoupled.

In operation 940, the image forming apparatus 100 may generate a signal requesting decoupling of the one or more consumables 200 corresponding to the consumable access condition. For example, the image forming apparatus 100 may generate a signal corresponding to the consumable access condition or requesting decoupling of the one or more consumables 200 designated by the user, based on the received user input.

When the image forming apparatus 100 does not provide the option of activating the pop-up window display or the option is set not to display the pop-up window in order to minimize an intervention of the user in operation 910, the image forming apparatus 100 may immediately generate the signal requesting decoupling of the one or more consumables 200 corresponding to the consumable access condition in operation 940.

FIG. 10 is a diagram illustrating a user interface screen for setting a consumable access condition for a consumable access control according to an example.

Referring to FIG. 10, the user interface screen may provide various menu items for setting the consumable access condition for the consumable access control. For example, when the cover 101 of the image forming apparatus 100 opens, the consumable access condition may be set such that decoupling of the one or more consumables 200 corresponding to a replacement condition or an inspection condition is always performed. In addition, a predetermined condition may be set such that decoupling of the one or more consumables 200 is performed only when each of a state of the image forming apparatus 100 and a state of the one or more consumables 200 satisfies the predetermined condition. For example, the predetermined condition may be set such as when the image forming apparatus 100 is in a predetermined operation mode or a previously designated user login mode, when a specific error code or a predetermined event such as a specific event has occurred in the image forming apparatus 100, when the image forming apparatus 100 corresponds to a predetermined period, when the state of the one or more consumables 200 is a state designated by a user, etc.

In addition, as shown in FIG. 10, the user interface screen may provide an option for activating the consumable access control, an option for activating decoupling of the consumables 200 corresponding to the consumable access condition, an option for activating a pop-up window display for receiving a user input of whether to decouple the one or more consumables 200 corresponding to the consumable access condition, etc.

A process related to the above-described method of removing a consumable 200 from the image forming apparatus 100 may be in part or wholly implemented by a computer-readable storage medium storing instructions or data executable by a computer or a processor. The examples may be written as computer programs and may be implemented in general-use digital computers that execute the programs by using a computer-readable storage medium. Examples of the computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disk, solid-status disk (SSD), and instructions or software, associated data, data files, and data structures, and any device capable of providing instructions or software, associated data, data files, and data structures to a processor or a computer such that the processor or computer may execute instructions.

What is claimed is:

1. An image forming apparatus comprising:

a coupling device to perform coupling or decoupling between the image forming apparatus and a consumable;

a sensor to sense an opening of a cover of the image forming apparatus;

a user interface device; and a processor to:

in response to receiving an opening sensing signal of the cover from the sensor, determine whether the consumable coupled to the image forming apparatus corresponds to a consumable access condition, based on the consumable corresponding to the consumable access condition, transmit a signal requesting decoupling of the consumable corresponding to the consumable access condition to the coupling device, and based on the consumable not corresponding to the consumable access condition, display a pop-up window to receive a user input through the user interface device, receive a user input with respect to the displayed pop-up window, and, based on the received user input, transmit the signal requesting decoupling of the consumable to the coupling device.

2. The image forming apparatus of claim 1, wherein the coupling device is further to:

unlock the consumable from the image forming apparatus, and push the consumable in a direction opposite to a direction in which the consumable is inserted into the image forming apparatus according to the transmitted signal requesting decoupling.

3. The image forming apparatus of claim 1, wherein the processor is further to:

through the user interface device, display a pop-up window for receiving a user input of whether to decouple the consumable corresponding to the consumable access condition, receive a user input with respect to the displayed pop-up window, and based on the received user input, transmit the signal requesting decoupling of the consumable corresponding to the consumable access condition to the coupling device.

4. The image forming apparatus of claim 1, wherein the processor is further to, in response to receiving the opening sensing signal of the cover, determine whether each of a state of the image forming apparatus and a state of the consumable coupled to the image forming apparatus corresponds to a predetermined condition.

5. The image forming apparatus of claim 4, wherein, in response to the consumable coupled to the image forming apparatus including a toner cartridge, the processor is further to:

determine whether an event related to the toner cartridge has occurred in the image forming apparatus, and determine whether the consumable coupled to the image forming apparatus corresponds to a replacement condition or an inspection condition.

6. The image forming apparatus of claim 4, wherein the processor is further to:

determine whether the image forming apparatus is in a predetermined operation mode or a predetermined login mode of a user, and determine whether the consumable coupled to the image forming apparatus corresponds to a replacement condition or an inspection condition.

7. The image forming apparatus of claim 1, further comprising a plurality of coupling devices corresponding to a plurality of consumables, wherein, a coupling device corresponding to the consumable corresponding to the consumable access condition performs decoupling between the consumable corresponding to the consumable access condition and the image forming apparatus.

8. A method of removing a consumable from an image forming apparatus, the method comprising:

sensing an opening of a cover of the image forming apparatus;

in response to the opening of the cover being sensed, determining whether a consumable coupled to the image forming apparatus corresponds to a consumable access condition;

based on the consumable corresponding to the consumable access condition:

generating a signal requesting decoupling of the consumable corresponding to the consumable access condition; and decoupling between the consumable corresponding to the consumable access condition and the image forming apparatus according to the generated signal requesting decoupling; and based on the consumable not corresponding to the consumable access condition:

displaying a pop-up window for receiving a user input through a user interface device of the image forming apparatus;

receiving a user input with respect to the displayed pop-up window; and based on the received user input, decoupling between the consumable and the image forming apparatus.

9. The method of claim 8, wherein the decoupling comprises:

unlocking the consumable from the image forming apparatus; and pushing the consumable in a direction opposite to a direction in which the is inserted into the image forming apparatus according to the generated signal requesting decoupling.

10. The method of claim 8, wherein the generating of the signal requesting decoupling comprises:

displaying a pop-up window for receiving a user input of whether to decouple the consumable corresponding to the consumable access condition;

receiving a user input with respect to the displayed pop-up window; and based on the received user input, generating the signal requesting decoupling of the consumable corresponding to the consumable access condition.

11. The method of claim 8, wherein the determining of whether the consumable coupled to the image forming apparatus corresponds to the consumable access condition comprises:

in response to the opening of the cover being sensed, determining whether each of a state of the image forming apparatus and a state of the consumable coupled to the image forming apparatus corresponds to a predetermined condition.

12. The method of claim 11, wherein, in response to the consumable coupled to the image forming apparatus including a toner cartridge, the determining of whether the consumable coupled to the image forming apparatus corresponds to the consumable access condition comprises:

determining whether an event related to the toner cartridge has occurred in the image forming apparatus and whether the consumable coupled to the image forming apparatus corresponds to a replacement condition or an inspection condition.

13. The method of claim 11, wherein the determining of whether the consumable coupled to the image forming apparatus corresponds to the consumable access condition comprises:

determining whether the image forming apparatus is in a predetermined operation mode or a predetermined login mode of a user; and determining whether the consumable coupled to the image forming apparatus corresponds to a replacement condition or an inspection condition.

14. The method of claim 8, wherein the decoupling comprises:

in response to a plurality of coupling devices corresponding to a plurality of consumables being provided in the image forming apparatus, a coupling device corresponding to the consumable corresponding to the consumable access condition performs decoupling between the consumable corresponding to the consumable access condition and the image forming apparatus.

15. A non-transitory computer-readable storage medium storing thereon instructions executable by a processor, the computer-readable storage medium comprising:

instructions to sense an opening of a cover of an image forming apparatus;

instructions to determine whether a consumable coupled to the image forming apparatus corresponds to a consumable access condition based on the opening of the cover being sensed;

instructions to, based on the consumable corresponding to the consumable access condition, request decoupling of the consumable corresponding to the consumable access condition; and instructions to, based on the consumable not corresponding to the consumable access condition, display a pop-up window to receive a user input through a user interface device, receive a user input with respect to the displayed pop-up window, and, based on the received user input, request decoupling of the consumable.

16. The non-transitory computer-readable storage medium of claim 15, wherein the consumable access condition comprises an incompatible cartridge.

* * * * *